US008388335B2

(12) United States Patent
Littlejohn et al.

(10) Patent No.: US 8,388,335 B2
(45) Date of Patent: Mar. 5, 2013

(54) BLANK CONTAINMENT DEVICE AND METHODS

(75) Inventors: Mark B. Littlejohn, Appleton, WI (US); Eric J. Berg, Appleton, WI (US); Daniel A. Duncan, Fort Smith, AR (US); James W. Gregory, Van Buren, AR (US); Kenneth J. Zirbel, Kaukauna, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 228 days.

(21) Appl. No.: 13/008,587

(22) Filed: Jan. 18, 2011

(65) Prior Publication Data

US 2012/0180546 A1 Jul. 19, 2012

(51) Int. Cl.
*B29C 51/00* (2006.01)
*B31B 1/12* (2006.01)

(52) U.S. Cl. ..... 425/397; 425/400; 493/143; 493/152; 271/195

(58) Field of Classification Search ..... 425/150, 425/397, 400; 493/143, 152, 168, 174; 271/195, 271/211

See application file for complete search history.

(56) References Cited

U.S. PATENT DOCUMENTS

| | | | | |
|---|---|---|---|---|
| 4,832,676 | A * | 5/1989 | Johns et al. | 493/152 |
| 6,592,357 | B1 | 7/2003 | Johns et al. | |
| 6,715,630 | B2 * | 4/2004 | Littlejohn et al. | 220/573 |
| D625,201 | S | 10/2010 | Wichmann | |
| 7,914,432 | B2 * | 3/2011 | Zelinski | 493/143 |

* cited by examiner

*Primary Examiner* — David B Jones
(74) *Attorney, Agent, or Firm* — William W. Letson

(57) ABSTRACT

Embodiments of the invention provide improvements to dies used in the formation of pressware from blanks. In some embodiments, the die includes at least one stop that helps contain the blank as it is fed to the die and that allows for improved adjustability of the stop with respect to the die. In some embodiments, the die includes a defined recess that contains and centers the blank on the die as the blank is fed to the die.

32 Claims, 16 Drawing Sheets

BLANK CONTAINMENT DEVICE AND METHODS

FIELD OF THE INVENTION

This invention generally relates to the manufacture of disposable pressware containers from container blanks on pressware forming apparatuses.

BACKGROUND OF THE INVENTION

Disposable pressware containers, such as plates, trays, bowls, and the like made from paperboard and other suitable materials are sometimes manufactured on an inclined die set. In a typical forming operation, a web of stock is fed continuously from a roll through a cutting die to form circular blanks. The cut blanks are then fed, typically by gravity, into position between upper and lower die halves of a die set, which is sometimes referred to herein as the forming apparatus.

As illustrated in FIG. 1, a typical die set 40 includes an upper die half 20 that opposes a lower die half 22 in a facing relationship. FIG. 1 is a simplified depiction of die set 40 for illustrative purposes. The upper die half is mounted for reciprocating movement in a direction that is typically inclined with respect to the vertical plane. A typical die set for forming pressware containers includes a male or punch die half, such as upper die half 20, and a female die half, such as lower die half 22. One or more portions of the die halves may be spring-biased such as by use of springs 25. The upper die half and the lower die half press the blank, which can be a circular paperboard blank, into the shape of a plate or other desired pressware.

In some instances, the lower die 22 has a base portion (such as base portion 30 shown in FIG. 1), a knock out (such as knock out 27 shown in FIG. 1) and a removable contour portion (such as contour portion 28 shown in FIG. 1). The upper die half 20 can similarly include a punch portion (such as punch portion 34 shown in FIG. 1) and a knock out (such as knock out 36 shown in FIG. 1). In some embodiments, the die set includes a pressure ring 24 and a draw ring 26. As discussed below, the draw ring helps control pleating during plate formation.

Paperboard plate stock is conventionally from about 0.01 to about 0.025 inches in thickness. With plate stock of such thickness, it is sometimes desirable to maintain spacing of less than 0.01 and 0.025 inches (slightly less than the thickness of the plate stock) between the pressure ring and the draw ring to create resistance that helps control the folds (pleating) evenly around the circumference of the plate. Specifically, the draw ring provides pressure on the outer circumferential area of the blank so that the blank is pulled onto the forming surface of the lower die half with some resistance.

To produce quality product at the desired rate, it is important to have consistent forming operations. In particular, it is important that the circular blank be properly positioned within the lower die half. A typical forming apparatus includes blank stops that are configured to stop a blank as it is fed into position between the upper and lower die halves. It is also desirable that the blank stops be configured to allow a container formed from such a blank to slide through and exit the die forming apparatus without obstruction.

As shown in FIGS. 2-4, a draw ring 26 includes at least one conventional blank stop 10 having a vertical member 12 that extends in a generally vertical orientation to stop the blank as it is fed into the forming apparatus. Such conventional blank stops are positioned with respect to the draw ring 26 using one or more spacers or shims 14, which are located between the blank stop 10 and the draw ring 26 and allow for the adjustment of the blank stops at discrete intervals. In this way, the blank stops can be positioned with respect to the forming apparatus to account for blank diameter variations, bounce, angled blank transfer chute delivery, blank curl, or other factors. However, adjustment of the blank stops is difficult because a bolt, such as bolt 15, has to be loosened and the appropriate shims inserted, which makes adjustment cumbersome and limited to the available shims. Moreover, the process can be dangerous because the operator inserting the shim is subjected to a burn risk from the forming apparatus, which is typically hot.

Blanks that are gravity fed to the die forming apparatus contact the fixed angular blank stops with significant speed and energy. As a result, blanks will often "bounce back" at least once before settling in between the two dies. If the blank is not centered between the two die halves, the product is formed off center, which results in a longer downturned edge on one side of the product when compared with the other side of the product. This differing downturned edge will often compromise product strength and impact visual stack aesthetics so the stacks do not look uniform. Thus, such off center formed products are rejected from the die set and discarded as waste.

Another alternative for catching the gravity fed blank is the use of rotating pin stops, such as pin stops 16 shown in FIGS. 5-8. These pin stops are attached to the draw ring die half (or elsewhere on the forming apparatus if a draw ring is not used) and the diameters of the pins are chosen to help center the blank in the die set. These pin stops may include adjustment screws 18 that allow the pin stops to be adjusted with respect to the forming dies. Such adjustment does not require the use of shims and allows for infinite adjustability in an inward/outward direction with respect to the die. In some configurations, as shown in FIG. 7, a set of two rotating pin stops per side (four pins total) may be used toward the front of the draw ring to stop the incoming blank. When the pin stops 16 are capable of spinning/rotating as shown in FIGS. 7-8, the rotation absorbs some of the kinetic energy of the gravity fed blanks and thus helps reduce blank bounce and off center forming of a non-uniform plate. The rotating pin stops also allow the blank to roll or move to an on center position more quickly, thus allowing consistent product formation at higher speeds.

In some embodiments, such as the one of FIG. 7, the back two pin stops are taller than the front two pin stops, so that the back two pin stops guide the blank as it is gravity fed into the die forming apparatus, the front two pins position the blank, and the formed plate can slide over the lower front two pin stops.

As described in U.S. Patent Publication No. 2007/0042072, which was filed on Aug. 18, 2006 and is incorporated herein by this reference, improvements have been made to conventional pressware forming machines to allow for at least one additional die pair in the pressware forming machine. This is achieved by narrowing the die pairs used in the machine so that an additional die pair fits within the machine. Because of the narrowing of the die pairs, only two rotating pin stops 16 (as opposed to four) are capable of fitting with each narrowed die pair, as illustrated in FIG. 8. Thus, the draw ring includes two rotating pin stops 16 and two non-rotating guide pins 17. Using two rotating pin stops instead of four rotating pin stops is not as effective at absorbing the kinetic energy associated with the gravity fed blank as it hits the rotating pin stops. Specifically, the inventors have found that there is undesired "bounce back" associated with the use of only two rotating pin stops, which can result in off center forming of plates, as described above. In addition, the pin stops are not as effective at stopping the gravity fed blank as the blank stop 10 shown in FIGS. 2-4. Specifically, when using the pin stops 16, the blank is capable of sliding across the top of one or both of the rotating pin stops as it is gravity fed into the die set.

SUMMARY OF THE INVENTION

Embodiments of the invention provide improved apparatuses and methods for the formation of pressware from blanks. The blanks can be paperboard blanks or blanks of another suitable material. In some embodiments, the apparatus has a lower die that includes improved stops that help contain the blank as the blank is fed to the die and that allow for better adjustability of the stop with respect to the die. Such stops are configured to be used with narrow tooling. In some embodiments, the die includes a defined recess that helps contain and center the blank as it is fed to the die.

Accurate and complete understanding of the way in which this invention works is not necessary to practice the invention, and Applicants do not wish to be bound by the forgoing or any other understanding of how their invention or any of the prior art works.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Figure 1:
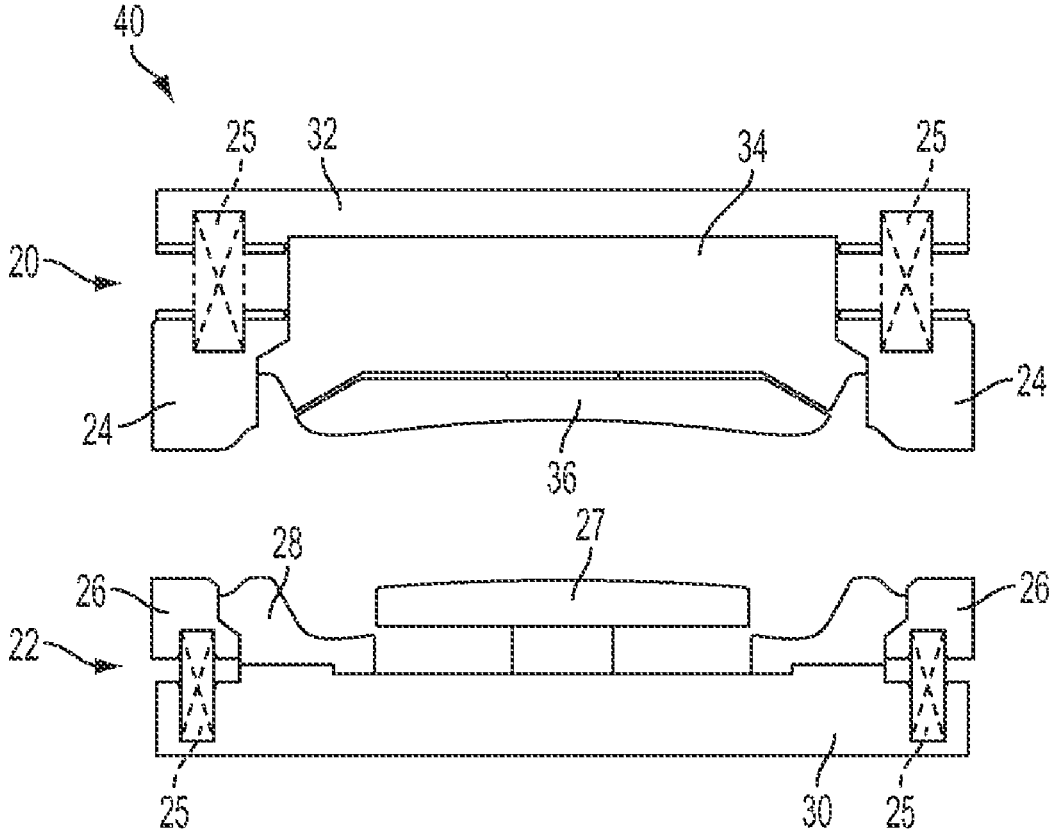
FIG. 1 PRIOR ART
FIG. 1 is a simplified cross-sectional view of a conventional die set.
Figure 2:
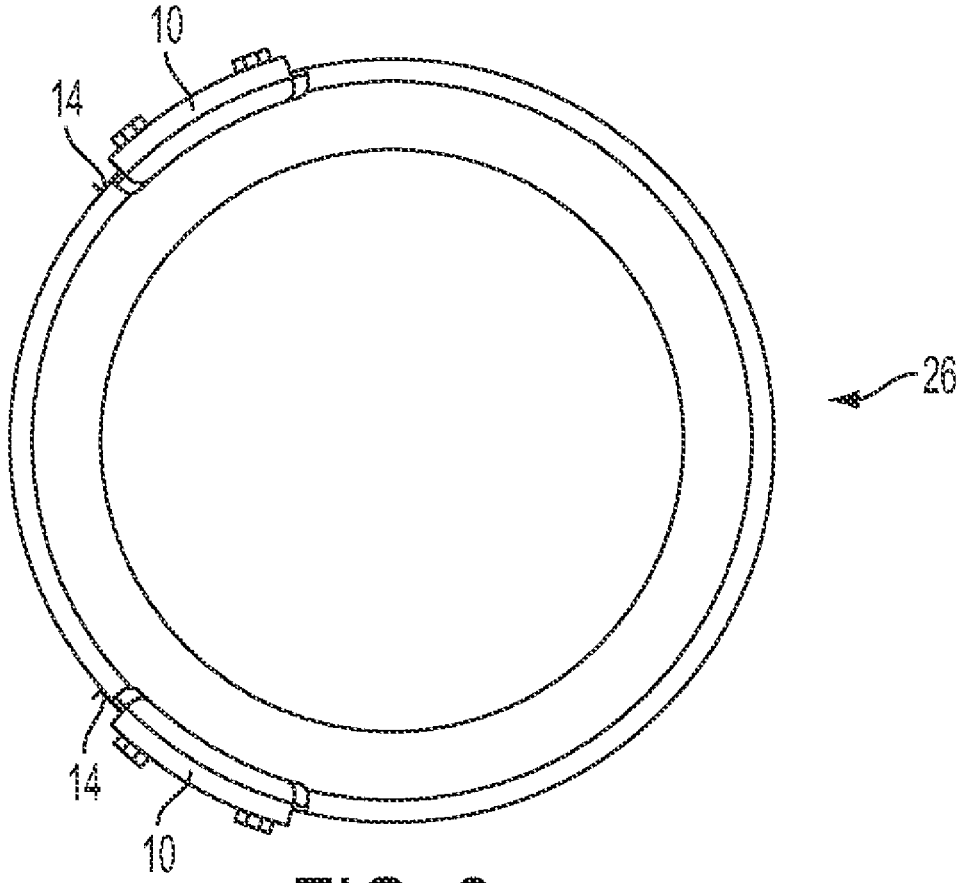
FIG. 2 PRIOR ART
FIG. 2 is a top plan view of a conventional lower die half draw ring with conventional blank stops.
Figure 3:
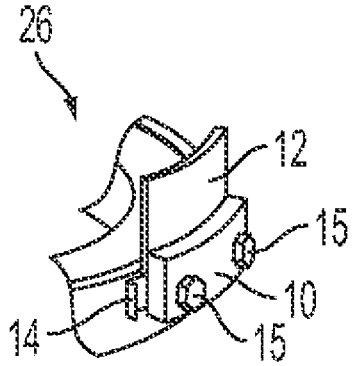
FIG. 3 PRIOR ART
FIG. 3 is a partial side perspective view of the lower die half draw ring of FIG. 2.
Figure 4:
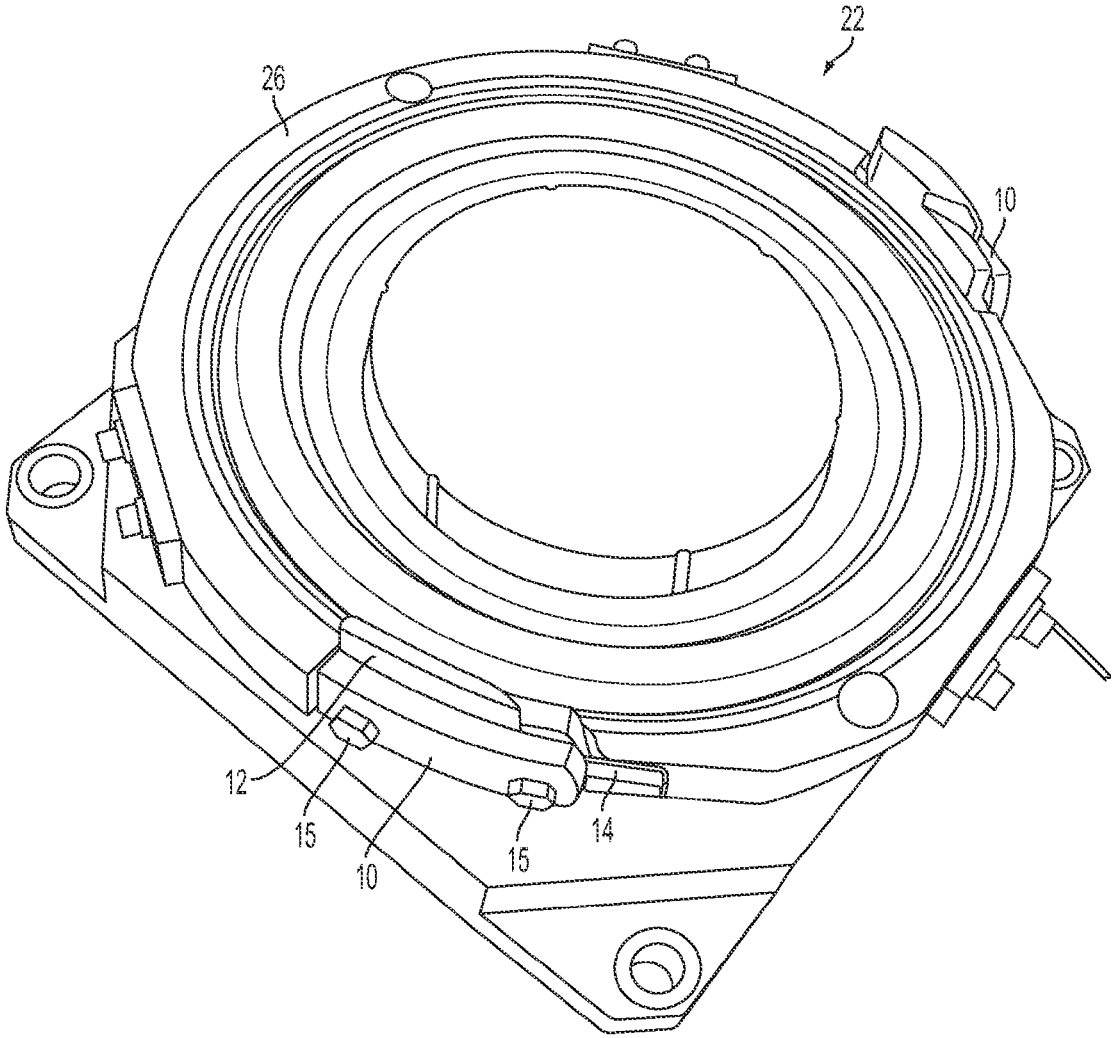
FIG. 4 PRIOR ART
FIG. 4 is a perspective view of a lower die half with conventional blank stops.
Figure 5:
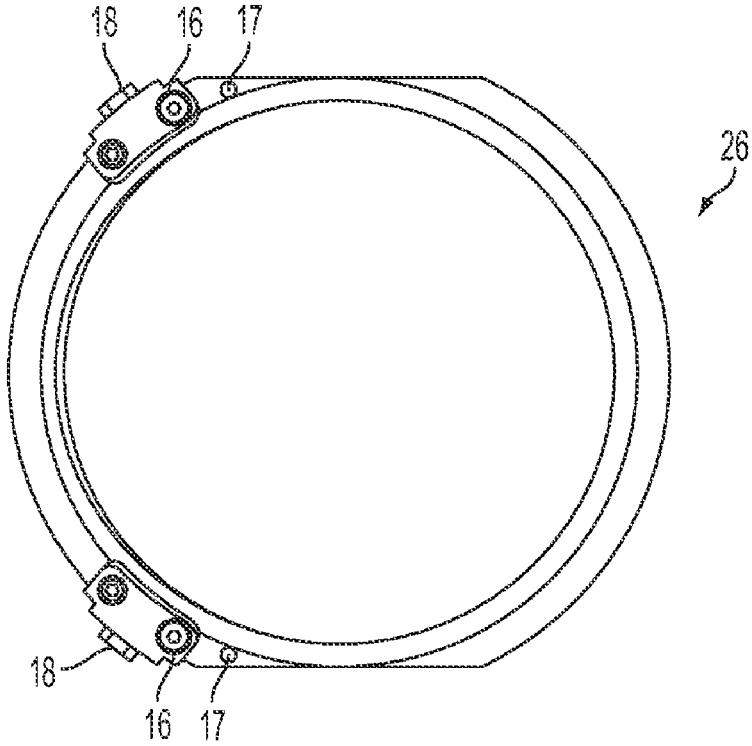
FIG. 5 PRIOR ART
FIG. 5 is a top plan view of another embodiment of a conventional lower die half draw ring having two rotating pin stops and two non-rotating guide pins.
Figure 6:
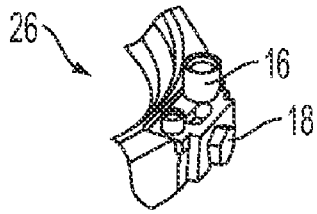
FIG. 6 PRIOR ART
FIG. 6 is a partial side perspective view of the lower die half draw ring of FIG. 5.
Figure 7:
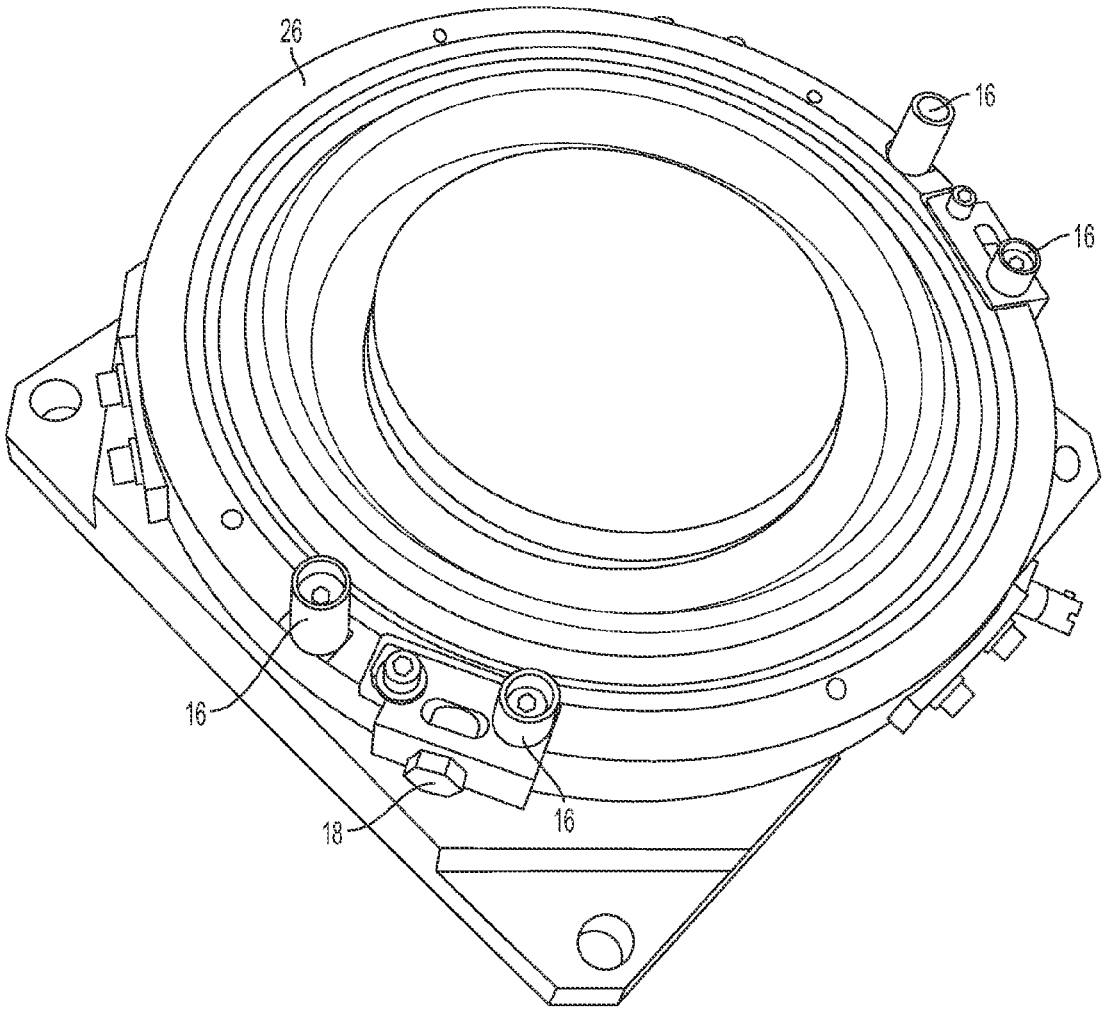
FIG. 7 PRIOR ART
FIG. 7 is a perspective view of a conventional lower die half having four rotating pin stops.
Figure 8:
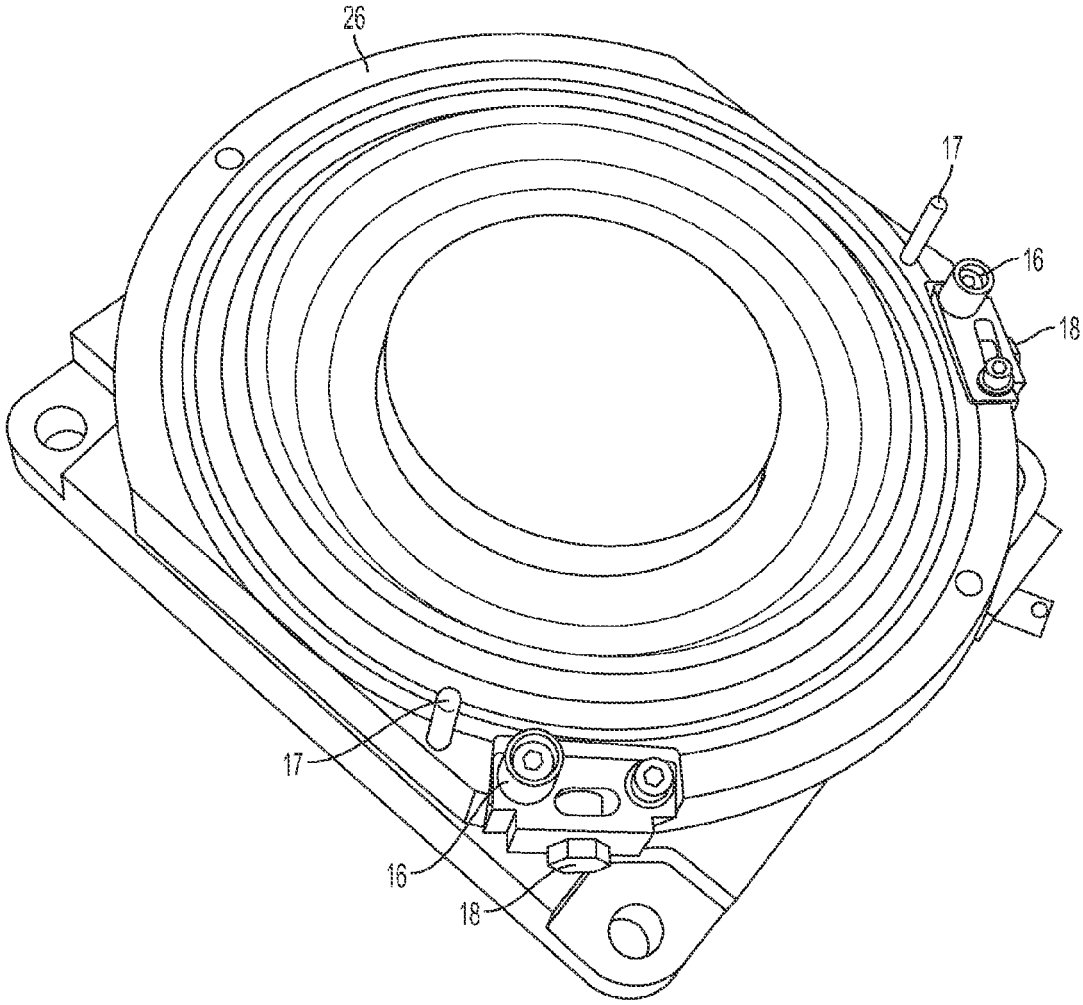
FIG. 8 PRIOR ART
FIG. 8 is a perspective view of a narrow lower die half having two rotating pin stops and two non-rotating guide pins.
Figure 9:
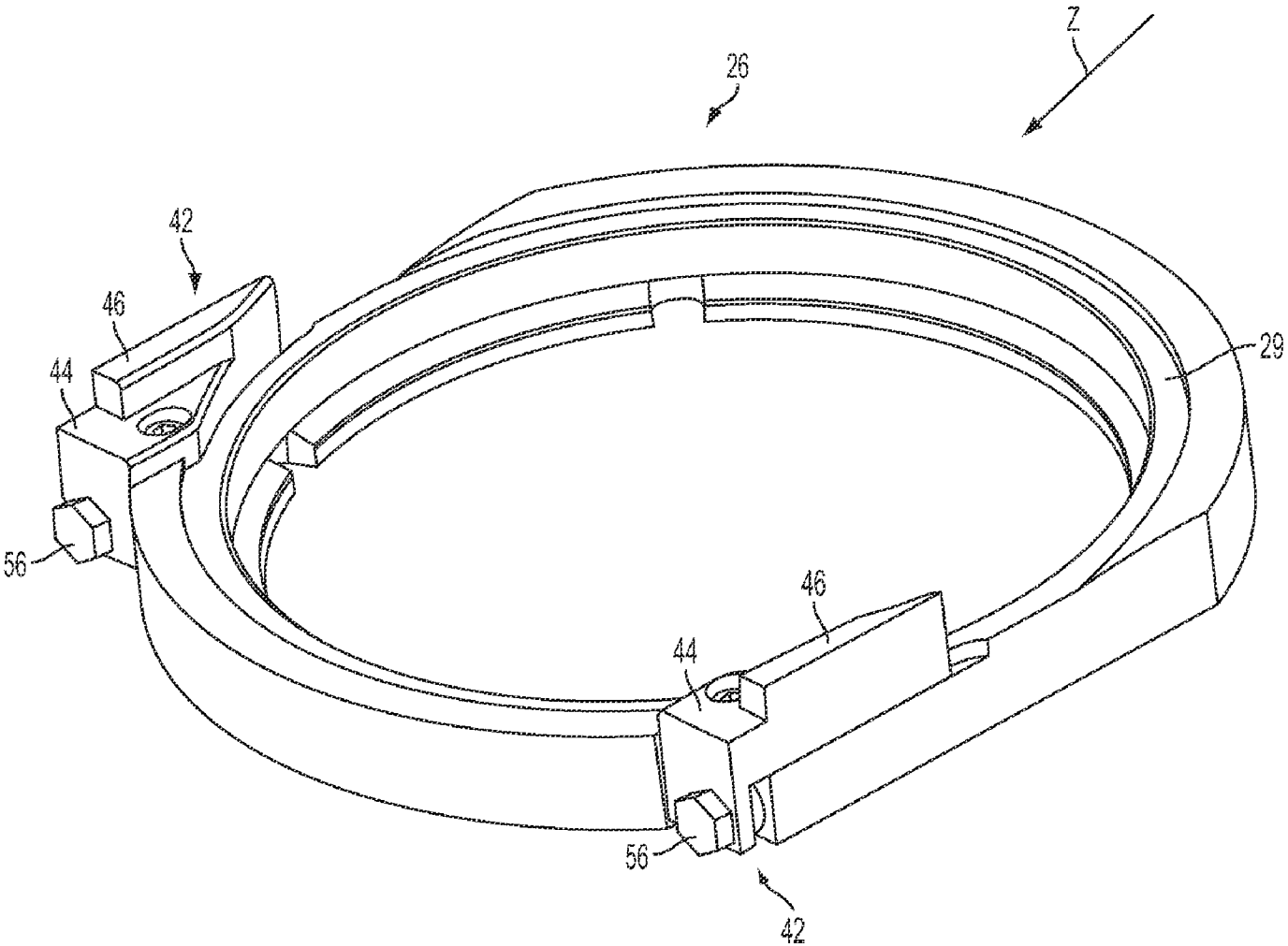
FIG. 9 is a top perspective view of a lower die half draw ring according to one embodiment of the invention.
Figure 10:
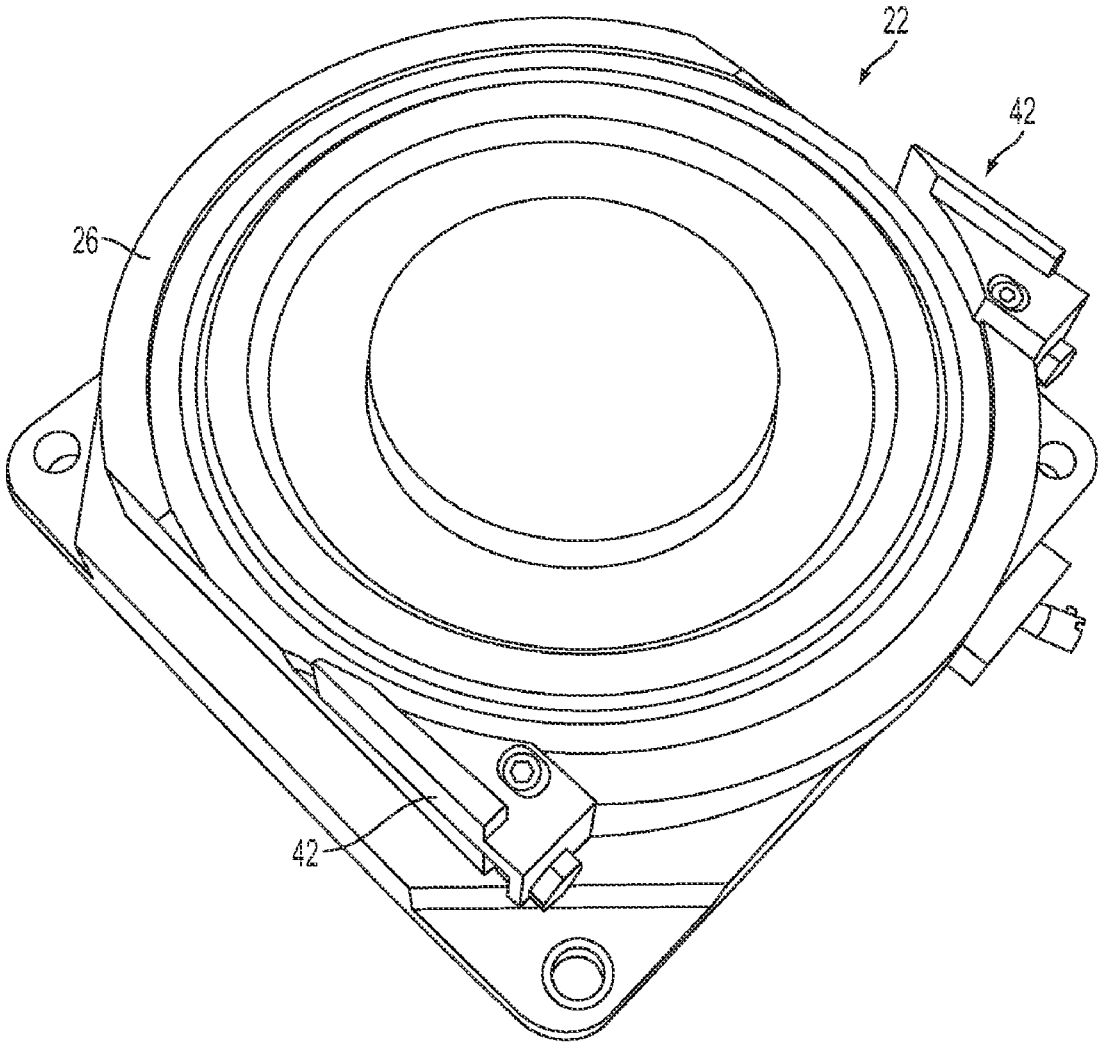
FIG. 10 is a perspective view of a narrow lower die having two stops according to one embodiment of the invention.
Figure 11:
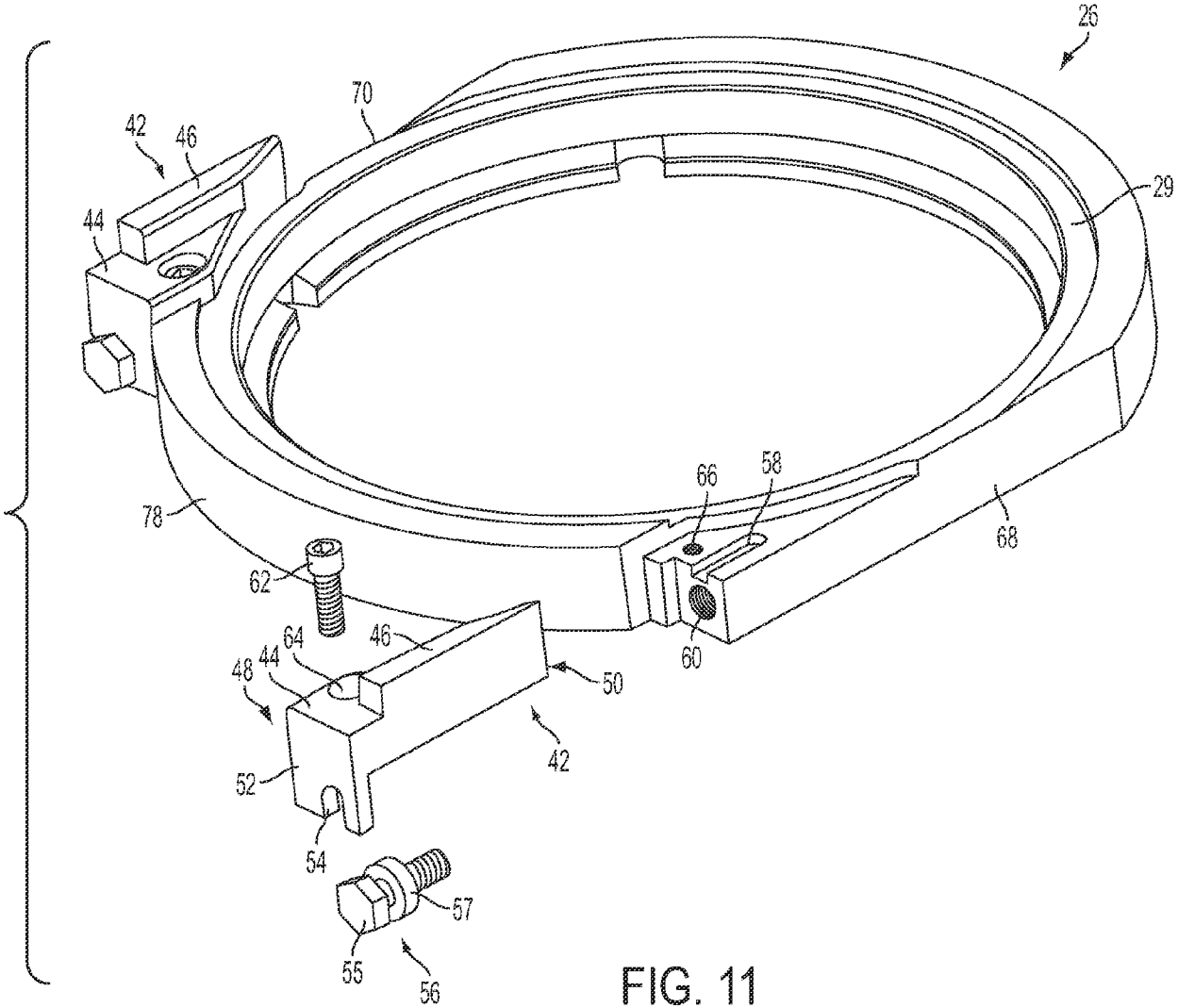
FIG. 11 is an exploded view of the lower die half draw ring of FIG. 9.
Figure 12:
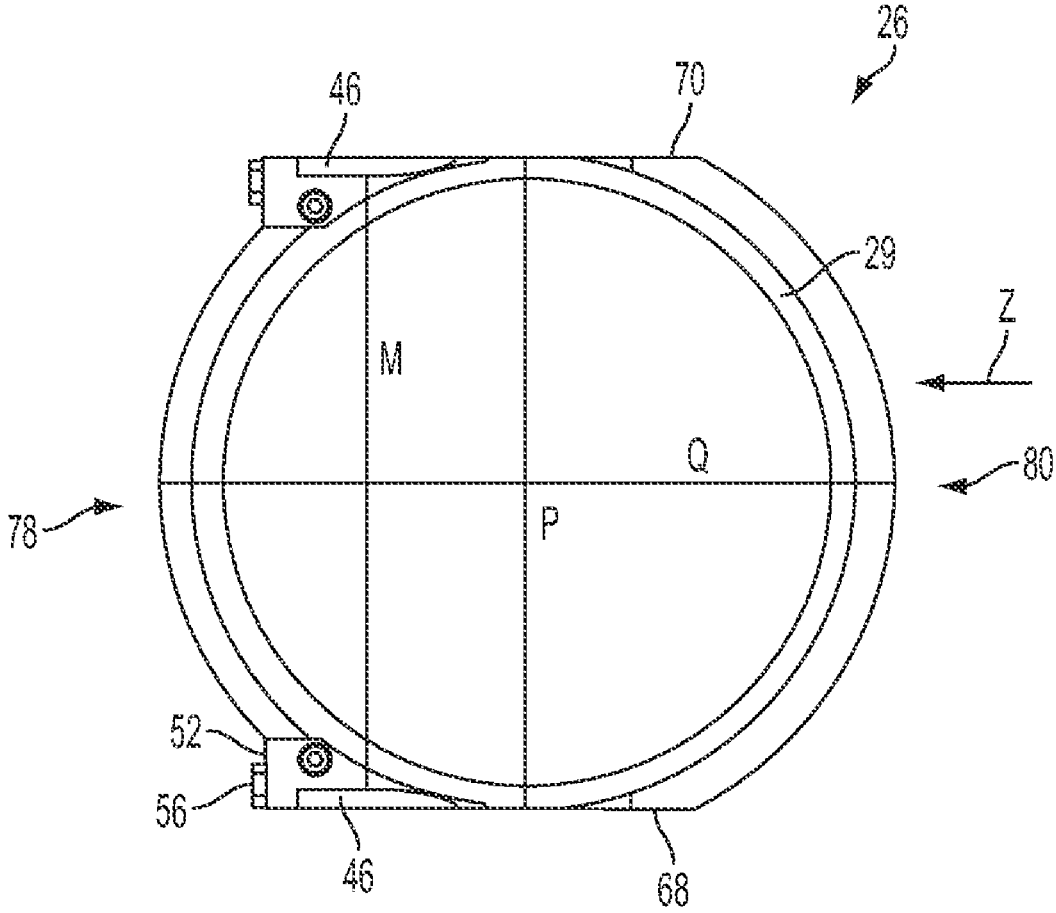
FIG. 12 is a top plan view of the lower die half draw ring of FIG. 9.

FIGS. 9 and 11-13 illustrate a draw ring 26 of a lower die half comprising two stops 42. As a cut blank is fed in the Z direction into draw ring 26 toward the front 78 of the draw ring 26, stops 42 serve to catch the blank and guide it into proper position. In some embodiments, the cut blank is gravity fed into draw ring 26, but other suitable ways of feeding the blank into draw ring 26 are contemplated. Stop 42 includes a base 44 and an extension 46 that extends from base 44. As shown in FIG. 11, in some embodiments, stop 42 has a first end 48 and a second end 50. First end 48 includes a front surface 52 having a stop aperture 54. In some embodiments, front surface 52 is substantially planar. Stop aperture 54 is shaped to receive an adjustment screw, such as an adjustment screw 56 or other suitable adjusting mechanism, for adjustably positioning the stop 42 with respect to the draw ring 26 by way of die aperture 60, which could be tapped to correspond to the threads on the end of the adjustment screw 56.

Figure 14:
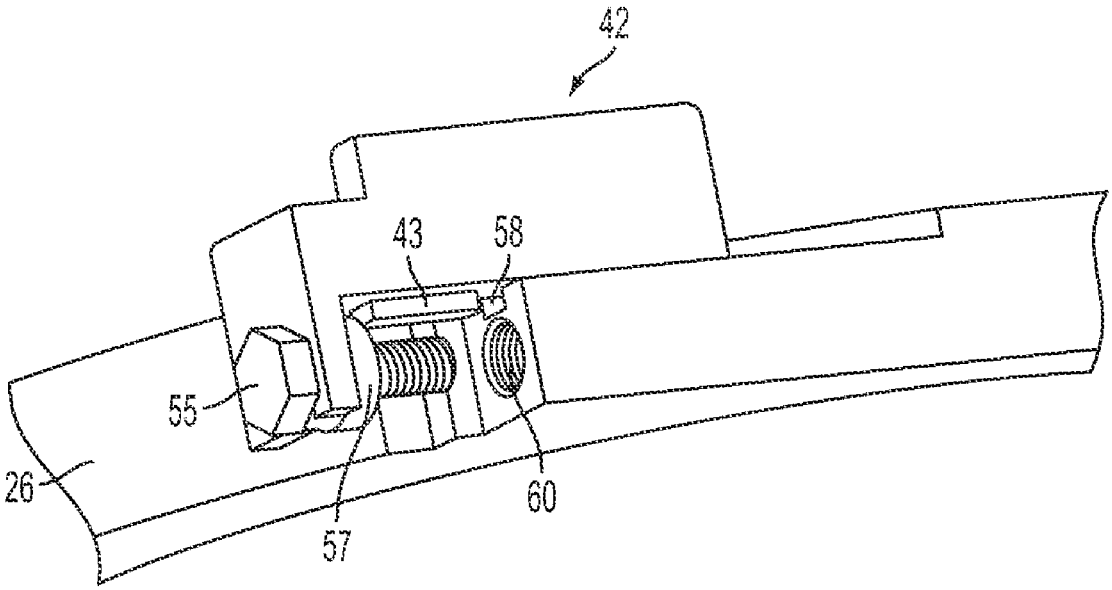
FIG. 14 is a bottom partial perspective view of one of the stops of FIG. 9 positioned with respect to the lower die half draw ring of FIG. 9.

In some embodiments, adjustment screw 56 includes a head portion 55 and a flange 57. As shown in FIG. 11, stop aperture 54 can be shaped to correspond to a gap formed between head portion 55 and flange 57. In the embodiment shown in FIG. 11, stop aperture 54 is a generally inverted U-shaped opening. The positioning of stop aperture 54 within the gap formed between head portion 55 and flange 57 of adjustment screw 56 as shown in FIG. 14 captures the stop 42 and prevents movement of the stop 42 with respect to the draw ring 26 unless adjustment screw 56 is rotated. When adjustment screw 56 is rotated, stop 42 is capable of translating along draw ring 26, as discussed below, in a controlled fashion.

Figure 13:
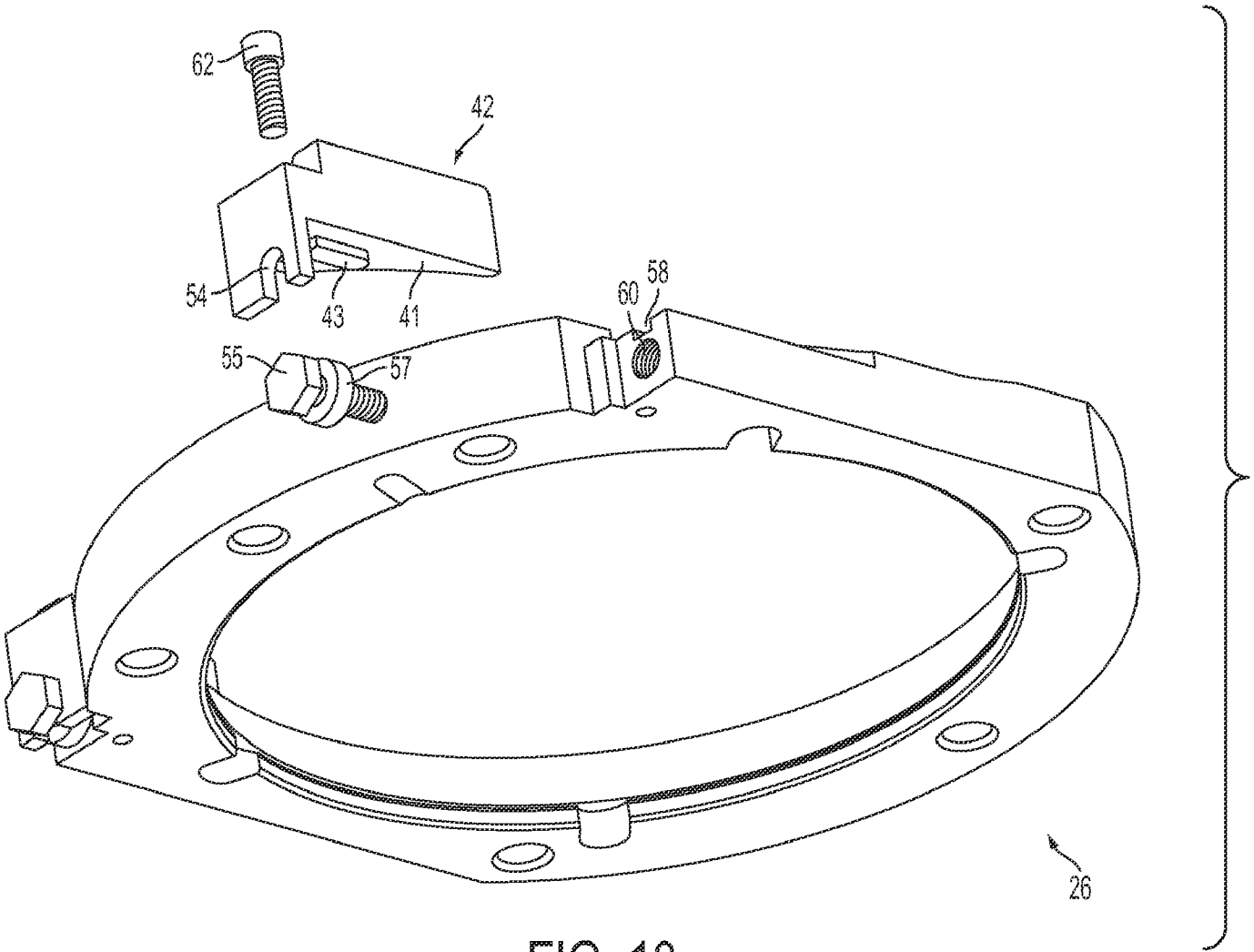
FIG. 13 is a bottom perspective view of the lower die half draw ring of FIG. 9.

As shown in FIGS. 13-14, the underside 41 of stop 42 includes a key or finger 43 that is configured to be received within groove 58 of draw ring 26. In other embodiments, the key is located on the draw ring and the groove is located on the stop. To adjust the positioning of stop 42 with respect to the draw ring 26, lock down bolt 62 is loosened, adjustment screw 56 is rotated, and key 43 of the underside 41 of the stop is translated along groove 58. In this way, groove 58 serves as a guide to maintain alignment of stop 42 with respect to draw ring 26. Once the desired positioning is achieved, lock down bolt 62, which extends through opening 64 of stop 42, is tightened to rigidly bolt stop 42 to draw ring 26 by way of opening 66, which could be tapped to correspond to the threads on the end of the lock down bolt 62 (see FIG. 11). Although the embodiment illustrated in FIGS. 13-14 includes a groove and a key feature, any suitable male and female mating components may be used to help guide the stop as it translates with respect to the draw ring. For example, a T-shaped component, a peg and aperture, a dovetail joint or the like may be used instead of a groove and key feature.

As shown in FIGS. 9-13, a portion of the stop 42 lies generally tangential with respect to draw ring 26. As described above, several die sets are typically positioned in a side-by-side relationship so that several plates can be formed on the forming machine at one time. For example, additional dies may be positioned adjacent to either or both of sides 68 and 70 of draw ring 26 (see FIG. 12). When narrow tooling is used, a dimension P of the lower die half is smaller than a dimension Q of the die so that an additional die set is accommodated on the machine. To allow for the inclusion of the additional dies, stops 42 are typically positioned on draw ring 26 so that they do not extend beyond dimension P. In addition, stop 42 is oriented with respect to draw ring 26 so that it is positioned at least partially along the front 78 of the lower die half so that adjustment screw 56 is accessible when stop 42 is used with narrow tooling. In particular, because adjustment screw 56 is positioned with respect to stop 42 at front surface 52 of first end 48, the positioning of stop 42 can be easily adjusted with respect to draw ring 26 without removing the die apparatus from the machine even when used with narrow tooling where several dies are adjacent one another. In embodiments where a draw ring 26 is not used, stop 42 may be positioned directly on lower die half 22 or at any suitable location on the forming apparatus.

Figure 15:
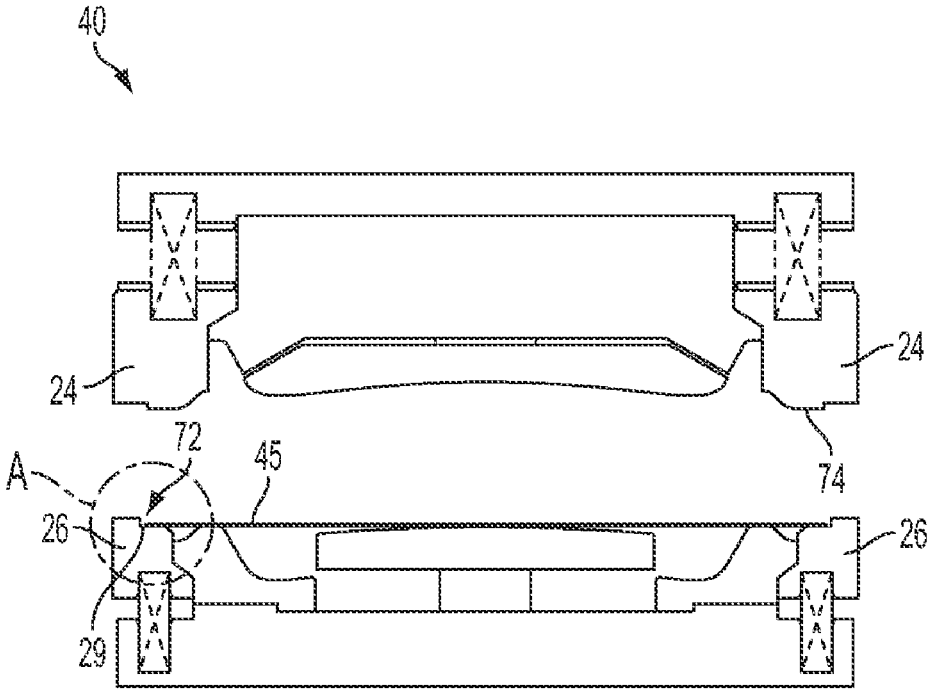
FIG. 15 is a simplified cross-sectional view of a die set according to one embodiment of the invention, shown in the open position.
Figure 16:
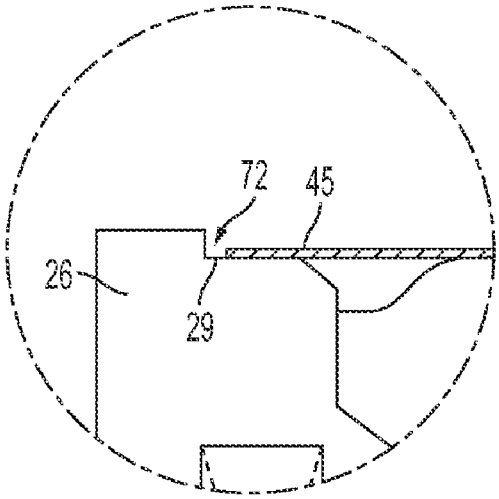
FIG. 16 is an enlarged view taken at inset circle A of FIG. 15.
Figure 17:
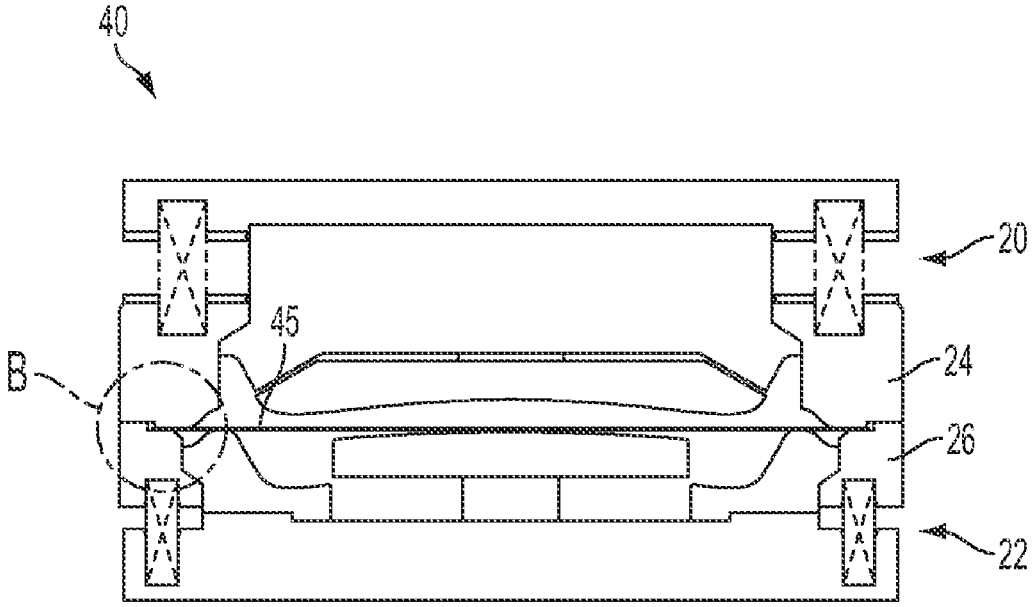
FIGS. 17 and 19 are simplified cross-sectional views of the die set of FIG. 15 as the die set moves from the open position to the closed position.
Figure 18:
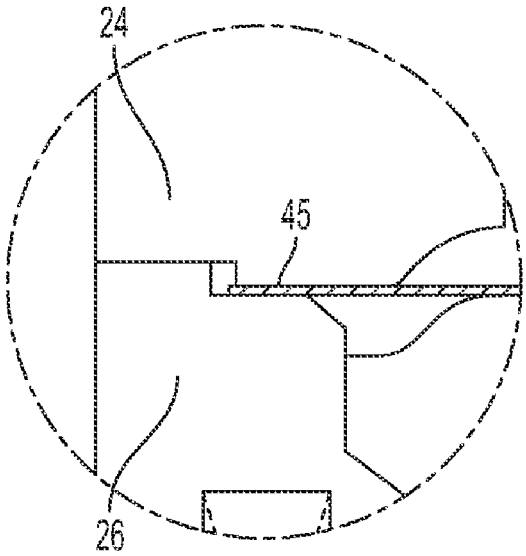
FIGS. 18 and 20 are enlarged views taken at insert circles B and C of FIGS. 17 and 19, respectively.
Figure 19:
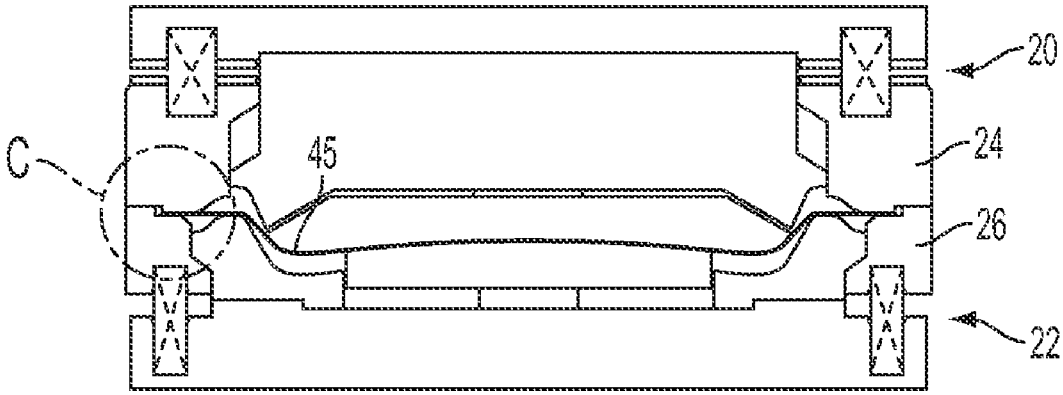

As described above and as illustrated in FIGS. 15-22, the die set 40 used to form the plates from blanks may include a draw ring 26 and a pressure ring 24. As shown in FIGS. 15-16, draw ring 26 may include a defined recess 72. In some embodiments, defined recess 72 is between about 0.04 inches and about 0.5 inches in height. In other embodiments, defined recess is between about 0.08 inches and about 0.2 inches in height. In some embodiments, the height of the defined recess 72 is in the range of about two to about thirty times the thickness of the plate stock, and in some embodiments, is between about five and about fifteen times the thickness of the plate stock. Including defined recess 72 in the draw ring 26 helps capture the blank as it is fed into the draw ring 26, preventing the blank from rebounding after impacting stops 42 and positioning the blank so that it is centered within draw ring 26. Specifically, the orientation of stop 42 on draw ring 26 helps stop the majority of blanks that are fed, while still allowing formed plates to clear over the top of base 44. Extension 46 then serves as a safeguard to catch blanks that may have gotten past base 44, as base 44 must be low enough in profile that formed plates are able to exit the system without obstruction.

Figure 20:
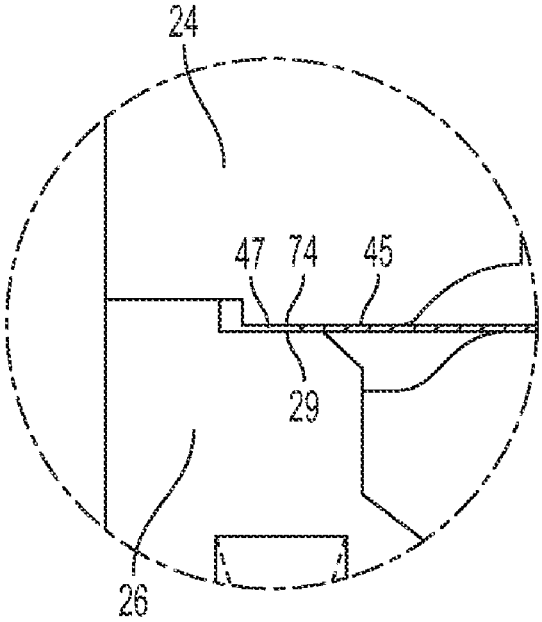
Figure 21:
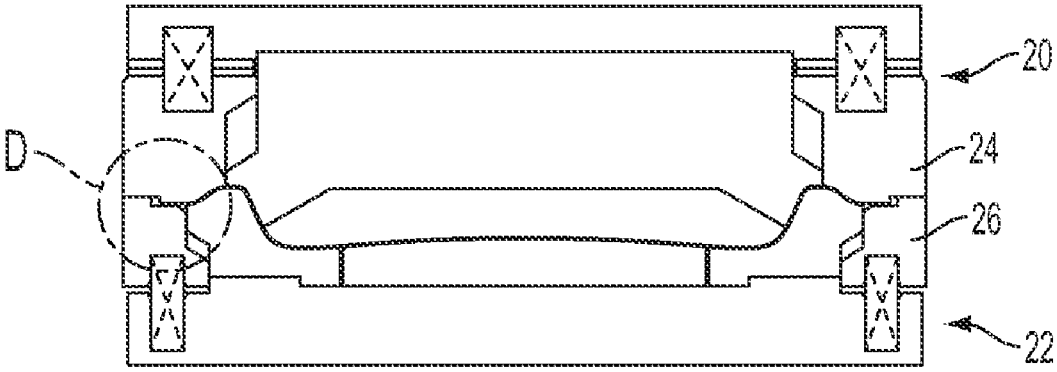
FIG. 21 is a simplified cross-sectional view of the die set of FIG. 15, shown in the closed position.
Figure 22:
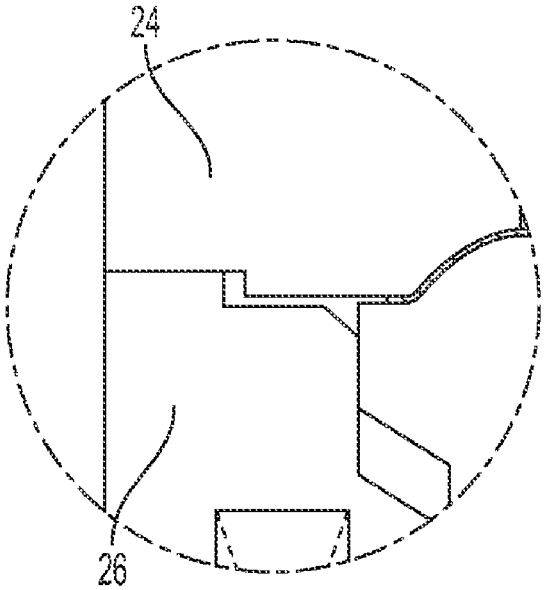
FIG. 22 is an enlarged view taken at inset circle D of FIG. 21.

Because stop 42 is fixedly attached to draw ring 26, blank rebound still may occur from the impact of the blank as it is fed into the die set. Defined recess 72 in draw ring 26 helps contain the blank in proper position as it is fed. Specifically, if the blank impacts the stop 42 in a way that causes the blank to rebound when entering draw ring 26, the back side wall of defined recess 72 restricts the movement of the blank. To maintain pleating control of the blank 45 during formation, surface 74 of pressure ring 24 is stepped down, as shown in FIG. 15, instead of being substantially planar, so as to create a slight gap 47 between the pressure ring surface 74 and the draw ring surface 29 during formation to impart pressure on the blank 45 (see FIG. 20). FIGS. 15-16 illustrates the die set 40 in the open position, while FIGS. 17-20 illustrate the draw ring 26 and the pressure ring 24 in contact to impart slight pressure on the periphery of the blank 45. FIG. 20 illustrates how a slight gap 47 is maintained between the stepped surface 74 of pressure ring 24 and draw ring surface 29 when the pressure ring 24 contacts draw ring 26. The gap 47 formed between the pressure ring 24 and the draw ring 26 is approximately equal to the thickness of the blank. FIGS. 21-22 illustrate the complete closing of die set 40 so that upper die half 20 fully mates with lower die half 22.

The combination of the improved stop 42 with defined recess 72 has led to unexpected results. Production speed and product quality has greatly increased, while waste has been reduced due to a lower number of malformed or off center plates. For example, an increase in press speed of up to about 15% has been realized with the combination of improved stop 42 and defined recess 72. Moreover, the combination of the defined recess 72 and the improved stop 42 allows for the creation of plates having certain characteristics, where the creation of such plates on conventional tooling would not be possible. For example, a plate having a low wrapping downturn, such as the plate disclosed in U.S. Ser. No. 12/728,31 filed on Mar. 22, 2010, the contents of which are herein incorporated by reference, is capable of being formed using the tooling described above. Specifically, the height of the base 44 of stop 42 must be lower than the downturn of the plate to be formed so that the formed plate can exit the die assembly without obstruction. In addition, the distance M (shown in FIG. 12) between extensions 42 must be greater than the diameter of the formed plate so the plate can exit the die assembly.

Also disclosed are methods for containing and centering blanks that are fed to forming dies. In one embodiment, a blank is fed in a Z direction so that the blank reaches the back portion 80 of the draw ring 26 and then proceeds toward the front portion 78 of the draw ring 26 (see FIG. 12). At least one stop 42 coupled to the draw ring 26 is configured to help stop the movement of the blank in the Z direction. In embodiments having more than one stop 42, such as the embodiment shown in FIGS. 9-13, either one or more of the stops 42 may be adjusted with respect to lower die 26 so that the blank is properly positioned within lower die 26. In some embodiments, the lower die 22 includes a draw ring 26 that has a defined recess 72. The defined recess 72 is configured to help capture the blank and position it within the draw ring 26. Also disclosed is a method of forming a blank into pressware using lower die half 22 and upper die half 20. In some embodiments, upper die half 20 includes a pressure ring 24 having a lower surface 74 that is stepped to correspond with defined recess 72 so that a gap is provided between pressure ring 24 and draw ring 26 when upper die half 20 mates with lower die half 22. This gap, which in some embodiments is approximately equal to the thickness of the blank, imparts pressure on the blank and helps control pleating of the blank as it is formed into pressware.

Numerous modifications of this invention may be made in the composition, application, manufacturing process and other aspects of this invention without departing from the objectives and spirit of the description above and in the Figures.

The invention claimed is:

1. An apparatus for forming pressware comprising:

(a) a lower die comprising:

a front portion, a back portion, and two side portions;

at least one of either a female or male location feature, at least a portion of which is located on the front portion of the lower die; and a die aperture;

(b) at least one stop comprising:

a front surface having a stop aperture;

at least one of the other of the female or male location feature that is configured to mate with the at least one female or male location feature of the lower die;

a base and an extension extending from the base; and an adjuster that is receivable within the stop aperture and receivable within the die aperture;

wherein, when the adjuster is adjusted, the at least one male location feature is configured to traverse within the at least one female location feature to adjust the positioning of the at least one stop with respect to the front portion of the lower die.

2. The apparatus of claim 1, wherein the at least one male location feature is a key and the at least one female location feature is a groove.

3. The apparatus of claim 1, wherein the lower die comprises a first dimension between the front portion and the back portion and a second dimension between the two side portions, wherein the second dimension is smaller than the first dimension.

4. The apparatus of claim 1, wherein the adjuster comprises a longitudinal axis that is generally parallel to a direction in which blanks may be fed to the lower die.

5. The apparatus of claim 1, wherein the at least one stop further comprises a lock down bolt that affixes the at least one stop to the lower die.

6. The apparatus of claim 1, wherein the adjuster comprises a gap formed between a head portion and a flange of the adjuster and wherein the stop aperture is configured to be positioned within the gap of the adjuster.

7. The apparatus of claim 1, wherein the front surface of the at least one stop is substantially planar.

8. The apparatus of claim 6, wherein the stop aperture is of a generally inverted U-shape.

9. The apparatus of claim 1, wherein the at least one of the female or male location feature extends along the lower die so that the at least one stop lies generally tangential with respect to the lower die when the at least one male location feature and the at least one female location feature mate together.

10. The apparatus of claim 1, wherein the lower die further comprises a draw ring.

11. The apparatus of claim 1, wherein the adjuster is positioned with respect to the at least one stop so that the position of the at least one stop relative to the lower die can be adjusted from the front portion of the lower die.

12. The apparatus of claim 10, wherein the draw ring comprises a defined recess that extends around an interior of the lower die.

13. The apparatus of claim 12, wherein the defined recess is in the range of about two times to about thirty times a thickness of a blank to be received on the lower die.

14. The apparatus of claim 12, wherein the defined recess is at least about 0.04 inches in height.

15. The apparatus of claim 12, wherein the defined recess is between about 0.08 inches and about 0.2 inches in height.

16. The apparatus of claim 12, further comprising an upper die comprising a pressure ring configured to mate with the draw ring, the pressure ring comprising a lower surface that is not substantially planar.

17. The apparatus of claim 16, wherein the lower surface of the pressure ring is stepped so that at least a portion of the stepped lower surface corresponds to the defined recess of the draw ring.

18. The apparatus of claim 12, wherein the defined recess in the draw ring is configured to help capture a blank that is fed into the lower die.

19. An apparatus for forming pressware from blanks comprising:

a lower die comprising a draw ring, the draw ring comprising a defined recess that extends around an interior of the lower die and that is at least about 0.04 inches in height; and an upper die comprising a pressure ring that is configured to mate with the draw ring and that comprises a lower surface that is stepped to correspond to the defined recess of the draw ring.

20. The apparatus of claim 19, wherein the defined recess is about 0.08 inches to about 0.2 inches in height.

21. The apparatus of claim 19, wherein the lower surface of the pressure ring is not substantially planar.

22. The apparatus of claim 19, wherein the defined recess is configured to capture the blanks as they are fed to the lower die.

23. The apparatus of claim 19, wherein the height of the defined recess is in the range of about two times to about thirty times the thickness of the blanks.

24. The apparatus of claim 19, wherein the lower surface of the pressure ring is shaped so that a gap is maintained between the lower surface of the pressure ring and a surface of the draw ring when the pressure ring mates with the draw ring, wherein the gap comprises a height substantially equal to a thickness of the blanks.

25. An apparatus for forming pressware from blanks comprising:

a lower die comprising a back portion, a front portion, and two side portions, wherein the lower die further comprises a draw ring, wherein the draw ring comprises a defined recess that extends around the draw ring and that is adapted to assist in locating the blanks as they are fed onto the draw ring;

at least one stop that is connected to at least a portion of the front portion of the lower die, the at least one stop comprising a base and an extension that extends from the base; and an adjuster that provides adjustability of a position of the at least one stop with respect to the lower die;

wherein a height of the defined recess is at least about 0.04 inches; and wherein the apparatus is configured so that blanks approach the lower die from the back portion of the lower die as the blanks are fed.

26. The apparatus of claim 25, wherein the height of the defined recess is in the range of about 0.08 inches to about 0.2 inches.

27. The apparatus of claim 25, wherein the lower die further comprises at least one of a male or female location feature that is configured to receive at least one of the other of the male or female location feature of the at least one stop, wherein the female and male location features help maintain alignment of the at least one stop with respect to the lower die.

28. The apparatus of claim 25, further comprising an upper die comprising a pressure ring configured to mate with the draw ring, wherein a lower surface of the pressure ring is not substantially planar so that it corresponds to the defined recess of the draw ring.

29. The apparatus of claim 25, wherein the adjuster is positioned with respect to the at least one stop so that the position of the at least one stop relative to the lower die can be adjusted from the front portion of the lower die.

30. The apparatus of claim 25, wherein the height of the defined recess is between about two times and about thirty times a thickness of the blanks.

31. The apparatus of claim 28, wherein the lower surface of the pressure ring is shaped so that a gap having a height substantially equal to a thickness of the blanks is formed between the lower surface of the pressure ring and a surface of the draw ring when the pressure ring mates with the draw ring.

32. The apparatus of claim 27, wherein the at least one male location feature is a key and the at least one female location feature is a groove.

* * * * *